US006332414B1

(12) United States Patent
Tayrien et al.

(10) Patent No.: US 6,332,414 B1
(45) **Date of Patent: *Dec. 25, 2001**

(54) SEWING MACHINE ACCESSORY

(75) Inventors: Steven R. Tayrien, Northridge; Peter A. Terranova, Sherman Oaks, both of CA (US)

(73) Assignee: Wizarad Attachment Co., Inc., Parker, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/286,286

(22) Filed: Apr. 6, 1999

Related U.S. Application Data

(63) Continuation-in-part of application No. 08/953,625, filed on Oct. 17, 1997.

(51) Int. Cl.[7] ..... D05B 35/00
(52) U.S. Cl. ..... 112/136; 112/235; 112/470.31
(58) Field of Search ..... 112/240, 235, 112/151, 305, 475.03, 470.33

(56) References Cited

U.S. PATENT DOCUMENTS

| | | | | |
|---|---|---|---|---|
| 2,208,992 | * | 7/1940 | Lewis | 112/136 |
| 2,915,996 | * | 12/1959 | Charest | 112/151 |
| 4,459,928 | | 7/1984 | Eguchi . | |
| 4,532,874 | | 8/1985 | Eguchi et al. . | |
| 4,590,876 | * | 5/1986 | Mencke et al. | 112/153 |
| 4,817,544 | | 4/1989 | Ackermann et al. . | |
| 5,033,399 | | 7/1991 | Miyachi et al. . | |
| 5,050,515 | * | 9/1991 | Lawrie | 112/235 |
| 5,054,407 | * | 10/1991 | Rowley | 112/235 |
| 5,090,344 | * | 2/1992 | Wang | 112/151 |
| 5,131,337 | * | 7/1992 | Wang | 112/182 |
| 5,249,539 | * | 10/1993 | Hyca | 112/235 |
| 5,370,071 | * | 12/1994 | Ackermann | 112/235 |
| 5,373,797 | | 12/1994 | Bottoms et al. . | |
| 5,749,311 | * | 5/1998 | Kobayashi et al. | 112/240 |
| 5,911,184 | * | 6/1999 | Tayrien et al. | 112/136 |

* cited by examiner

*Primary Examiner*—John J. Calvert
*Assistant Examiner*—Tejash Patel
(74) *Attorney, Agent, or Firm*—Fulbright & Jaworski LLP

(57) ABSTRACT

A sewing machine accessory with an accessory head which can be quickly and easily attached and removed from a sewing machine. One version of the accessory head can be mounted to a sewing machine foot, while another version can be mounted on a sewing machine shank. Either version can use a protrusion in a mating slot to serve as the mounting connection, configured so that simply inserting the protrusion into the slot is sufficient for attachment, and simply removing the protrusion from the slot is sufficient for detachment. A particular embodiment of the accessory can enable straight seams or hems to be sewn parallel to a material edge without requiring a steady hand or great skill by the operator. An edge guide is provided with a predetermined offset from the sewing machine needle, thus permitting the operator to guide the material through the sewing mechanism in a very straight line, with the resulting seam being a consistently accurate distance from the edge of the material. The invention can include multiple guides in various sizes that can be quickly and easily interchanged. Customized feet can be provided to allow the invention to be retrofitted onto existing sewing machines.

17 Claims, 8 Drawing Sheets

SEWING MACHINE ACCESSORY

CROSS REFERENCE TO RELATED APPLICATIONS

This is a Continuation-In-Part of U.S. application Ser. No. 08/953,625, filed Oct. 17, 1997.

BACKGROUND OF THE INVENTION

1. Field of the Invention

The invention relates to an improvement to a sewing machine. More particularly, the invention relates to an improvement that allows easy attachment and removal of accessories to a sewing machine that aid in the sewing operation.

2. Description of the Related Technology

The heart of the basic sewing machine is referred to herein as the "sewing mechanism", and typically contains an upper and lower part. The upper part contains a needle, a source of thread for the needle, and a foot which acts to hold the material down. The lower part contains a flat base, a secondary source of thread called a bobbin, and a set of movable gripping teeth. In operation, the materials being sewn pass between the upper and lower parts. The materials lay on the top surface of the base, are held flat against the base by the foot, and are moved forward by the action of the teeth. Interaction between the needle and the bobbin sews the fabric together at a location directly beneath the foot. This basic process has remained relatively constant since the sewing machine was invented many years ago. However, a great many improvements have been developed which allow specialized functions to be performed. These improvements generally permit such functions to be performed automatically by the machine rather than depending on the skill of the operator to perform them. Examples of such improvements are the capability for making button holes, for sewing specific types of seams, and for sewing decorative applique designs on the material.

One area which has not benefited from such automation, however, is the attachment of elastic to predominantly non-elastic materials. For such an attachment to work properly, the elastic must be prestretched before being sewn to the material and it must remain stretched as it is being sewn. Once the elastic has been sewn and released, it returns to its normal non-stretched configuration. The result is an area of material, such as the waistband of a dress, which is normally in a "gathered" configuration but can be stretched to a larger dimension. The extra gathered fabric allows the normally non-stretchable material to effectively be stretched, while the tension in the stretched elastic provides the proper force to hold the article of clothing snugly in place.

In a typical sewing machine, the operator must manually hold the elastic in a stretched position by hand while feeding it and the fabric into the sewing mechanism. Since the operator must accurately guide the fabric and the elastic while simultaneously maintaining the proper tension on the elastic, the resulting operation is awkward and requires a great deal of skill on the part of the operator. If other materials are simultaneously being sewn into the same area, this just compounds the problem. What is needed is a device that will prestretch the elastic as it is being sewn without requiring any manual intervention by the operator.

In a related area, sewing machine operators sometimes wish to sew multiple strips of linear material, such as elastic, ribbons, strips of lace, etc., onto the same area of fabric at the same time, while accurately maintaining these strips of material in a particular configuration with respect to each other. This function requires the operator to manually guide these multiple strips and accurately maintain their proper position while simultaneously tending to the other manual operations that the operator must perform. These multiple manual operations require a great deal of skill on the part of the operator, and increase the chance for error. What is needed is a mechanism that will automatically guide various sizes of ribbon and other linear material into the sewing mechanism while accurately maintaining their proper positional orientation.

Manual skill is also needed to sew a controlled distance from a material edge or other reference line. Although various accessories have been developed to allow controlled sewing of seams, hems, and other stitching applications, these accessories are generally non-removable, or removable only by disassembling a portion of the machine. Such permanent and semipermanent attachments may be suitable for repetitive high-volume work such as that performed by a large commercial clothing manufacturer, but the difficulty or impossibility of replacing attachments makes them unsuited for low-volume work, where specialized attachments must be frequently swapped out. The related technology lacks an easily-replaceable accessory that aids the operator in controlled sewing applications.

For widespread acceptance, the aforementioned needs should be met by a device that is inexpensive and simple to use so that it will appeal to the many people who sew in their homes on their personal sewing machines. It should be attachable or removable by the operator within a few seconds with no tools and no special training. It should also be capable of being easily retrofitted onto existing sewing machines.

SUMMARY OF THE INVENTION

The invention described herein solves the aforementioned problems of the prior art through the use of a device or a family of devices that may be removably affixed to a sewing machine. These devices can be affixed and operated by persons of minimal skill and experience. In a preferred embodiment, the invention includes two parts. The first may be a mounting portion which is connected to the sewing machine, preferably either in the form of the sewing machine foot or the sewing machine shank. The second may be an accessory head which performs the desired function and is easily attached to and removed from the mounting portion.

In a preferred embodiment, the accessory head may removably attached to the foot of the sewing machine by sliding it onto an upright protrusion provided for this purpose. The foot is a ski-shaped device which rests on top of the material being sewn and holds that material down. Since the foot is in close proximity to the needle and is used to help guide material under the needle, it represents an ideal location for attachments which will further automate the sewing process. An example of a conventional foot is shown in FIG. 2, while one embodiment of a foot of the invention is shown in FIG. 3. A vertical protrusion rising from the foot may be inserted into a mating slot in an accessory head. For accessories that are not subject to appreciable upward forces during a sewing operation, the force of gravity can be sufficient to hold the accessory head in place without the need for screws, clamps, or similar fastening devices. The attachment can be made even more secure by frictional forces between the slot and protrusion. Retaining forces may also be increased by the addition of appropriate mechanisms such as a clip, spring loaded ball engaging a detent, or even a magnet. Removing the accessory may be achieved simply by lifting the accessory head off the protrusion. Although the drawings show a single thin, rectangular shape for the protrusion and slot, other shapes can also be employed, as well as multiple protrusions and mating receptacles.

Examples of an accessory head are shown in FIGS. 4A and 4B, which depict a guide for ribbon, elastic, or other linear-shaped material. The invention is not limited to the illustrated accessory. As can be seen, the guide has a slot that penetrates the guide from top to bottom. The elastic, ribbon or other trim material feeds into this slot, which acts to accurately hold the trim material in place before it feeds into the sewing mechanism. Since positional accuracy is important, the width of this slot should be identical to, or slightly larger than, the width of the trim material being used. Since trim material comes in various widths, a family of guides with slots of various widths can be used. It is also possible to put a mechanical adjustment on the device which allows the operator to vary the width of this slot, thus allowing the operator to accommodate various sizes of trim with a single (but more complicated) guide. As shown in FIG. 4A, the guide also has a mounting cavity or receptacle, in this case shown as a second non-enclosed slot, which can be used to attach the guide to the foot. The foot must have a corresponding protrusion which fits into this non-enclosed slot when the guide is mounted to the foot. Since sewing machine feet typically do not come with such a protrusion, a special foot designed for such a purpose may be provided. The combination of non-enclosed slot on the guide and protrusion on the foot represent a preferred embodiment. However, other forms of mounting the guide on the foot, such as enclosed slots, might also be used.

In a typical home sewing machine, the invention may include a replacement foot which has been designed to take the place of the standard foot that came with the machine. The portion of the foot that attaches to the sewing machine can be custom-designed to fit that particular brand and model number of sewing machine, while the guide mount can be common to all such feet. Since the guide protrusion does not interfere with normal sewing, this specialized foot may remain on the sewing machine for standard operation when the guide is not being used. This combination of a custom foot with easily interchangeable guides allows the home operator a great deal of flexibility at low cost. Alternatively, for a more rigid mounting the guide can be attached to the sewing machine shank (or other portion of the sewing machine) by using a bracket, and the alignment portion can be either permanently or interchangeably connected to that bracket.

While the aforementioned slot can guide the trim material, an additional control is needed for prestretching elastic. This is accomplished by the screw 9 shown in FIG. 4A. Once the elastic has been fed through the guide and is in place, the operator may simply turn this screw until it contacts the elastic. By adjusting the screw, a variable amount of frictional force can be applied to the elastic. As the elastic is pulled through the slot by the action of the sewing machine, this frictional force tends to hold the elastic back, resulting in the elastic being stretched as it feeds into the machine. Turning the screw to adjust this tension will adjust the amount of stretch which is introduced into the elastic as it is sewn. This gives the operator the ability to control the amount of stretch which is automatically sewn into the elastic.

In an alternative embodiment, this device can also be used to feed multiple ribbons or other such trim pieces into the sewing mechanism at the same time. By having multiple slots, possibly of different widths, multiple such ribbons can be fed into the machine simultaneously and their desired orientation can be maintained without requiring the operator to manually hold them in place. As before, slots of various widths can be provided on different guides, or a single guide can have mechanical adjustments to control the width of these slots. Due to the simple design and inexpensive nature of the basic guide, the preferred embodiment uses multiple guides with different size slots rather than incorporating adjustable slots into a more complicated single guide.

In still another embodiment, an accessory can be provided to sew very straight hems or seams by using an alignment guide placed at a desired distance from the needle, thus permitting the operator to guide the material forward in a straight manner and stitch in a straight line.

The guide may be a transversely displaced element providing a reference at the desired distance. The guide may be a straight surface oriented parallel to the direction of fabric movement. The guide arm may be adjustable to permit the distance between the guide and the stitch to be varied.

In another embodiment, an accessory head does not attach to the foot, but instead may attach to the shank (which is normally located above the foot and can provide an attachment point for the foot) or to another point in the upper part of the sewing machine. The protrusion and-slot mounting arrangement may be the same as for a foot-mounted embodiment. An example of this version is described in U.S. design application Ser. No. 29/067,696, filed Mar. 5, 1997 and entitled "Elastic Applique Guide for Sewing Machine". That document is incorporated herein by reference in its entirety.

DETAILED DESCRIPTION OF THE INVENTION

Figure 1:
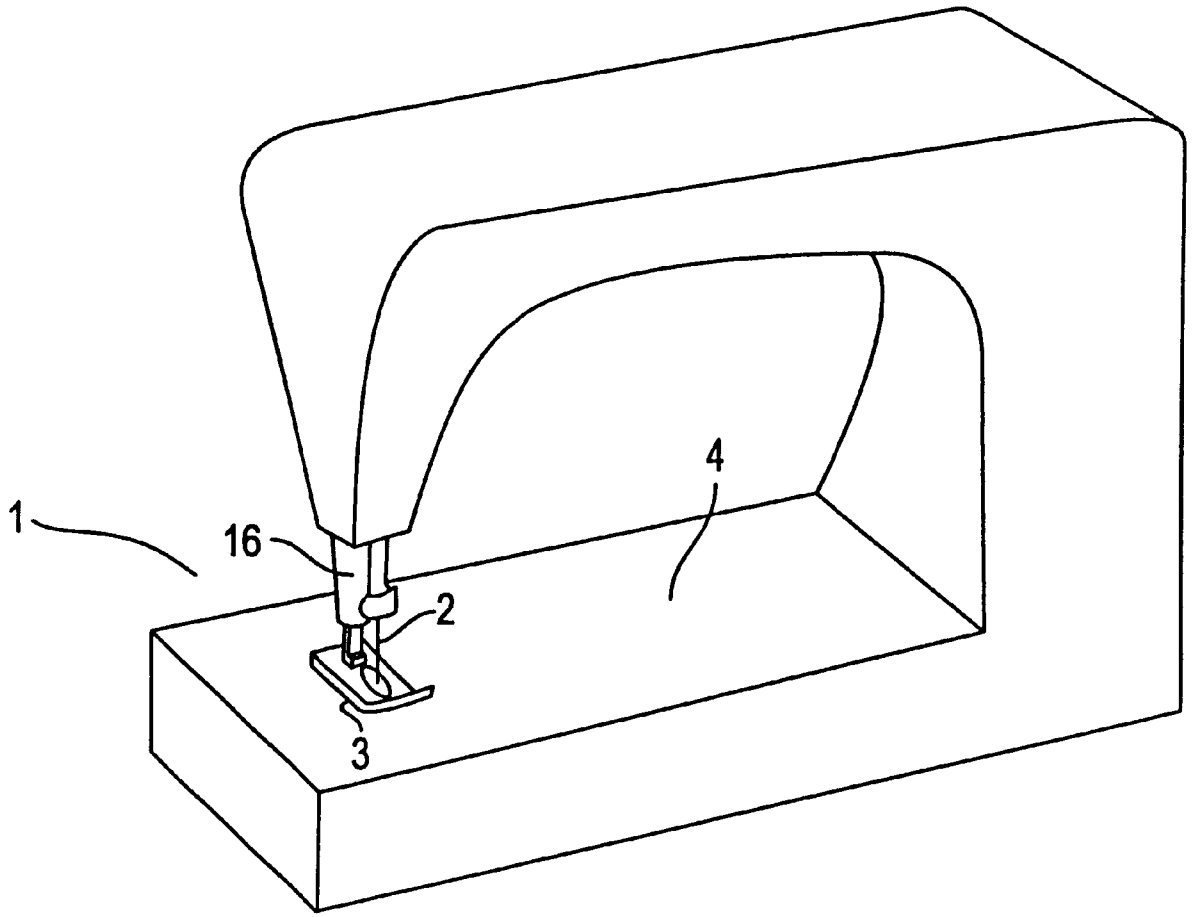
FIG. 1 (PRIOR ART)
FIG. 1 shows a standard sewing machine of the prior art.

FIG. 1 shows a standard sewing machine. The sewing mechanism 1 includes a needle 2, a shank 16, and a foot 3 that attaches to the shank, all of which are attached to the upper portion of the machine. The upper portion also contains a source of thread (not shown) which provides thread to the needle 2. The bottom portion of the machine contains a base 4. Directly underneath the foot, the base contains a set of moving teeth and a secondary source of thread called a bobbin (not shown because they are obscured by the foot). As the fabric being sewn passes between the base and the foot, the needle and bobbin move and interact in a manner that causes the fabric to be sewn with thread from the two thread sources. At the same time, the small moving teeth in the base grip the fabric from underneath and move it forward as it is being sewn.

In normal operation, the operator feeds two or more layers of fabric across the top of the base of the sewing machine and underneath the foot where the aforementioned action sews the fabric together. Various adjustments in the machine allow the operator to control the tension in both threads, the speed of the operation, and the pressure of the foot on the material, all of which can affect the quality and appearance of the finished result.

Figure 2:
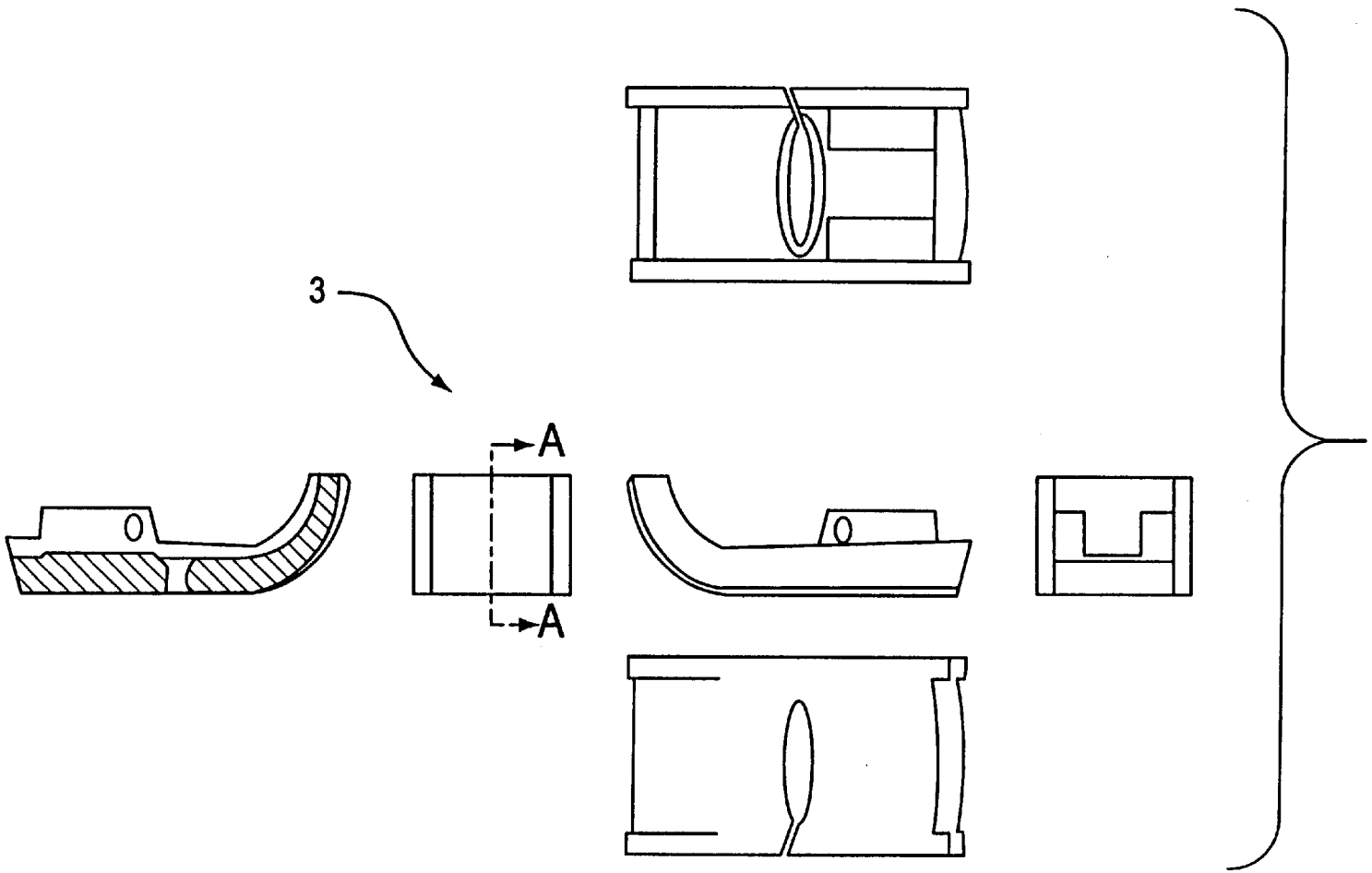
FIG. 2 (PRIOR ART)
FIG. 2 shows a standard sewing machine foot of the prior art.

FIG. 2 shows a detailed view of a standard foot 3, which has the general shape of a ski. Being curved and raised at the front end allows the operator to feed material underneath the foot without snagging or catching. The needle moves up and down through the hole in the center of foot and the fabric is sewn at that point. The sewn fabric exits from underneath the back of the foot.

Figure 3:
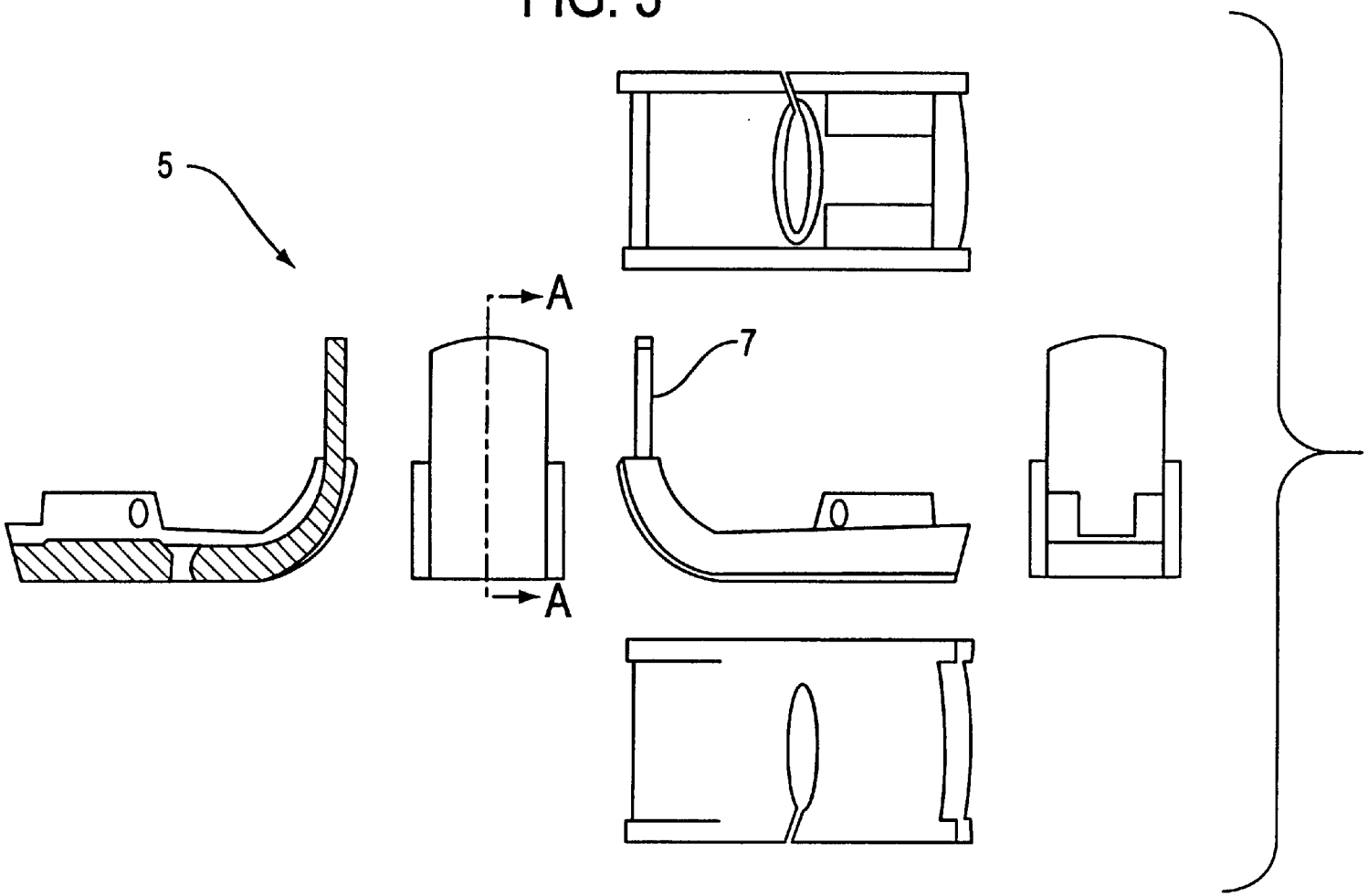
FIG. 3 shows the sewing machine foot of the invention.

Foot 5 of the current invention is shown in FIG. 3. It differs from a standard foot by having a vertical protrusion 7 rising from the front end. This vertical protrusion provides a mount for the various guides which can be simply slid onto the protrusion from above. The purpose of these guides is to hold and control various types of trim, such as ribbon, elastic, or other materials with a generally linear shape.

Figure 4A:
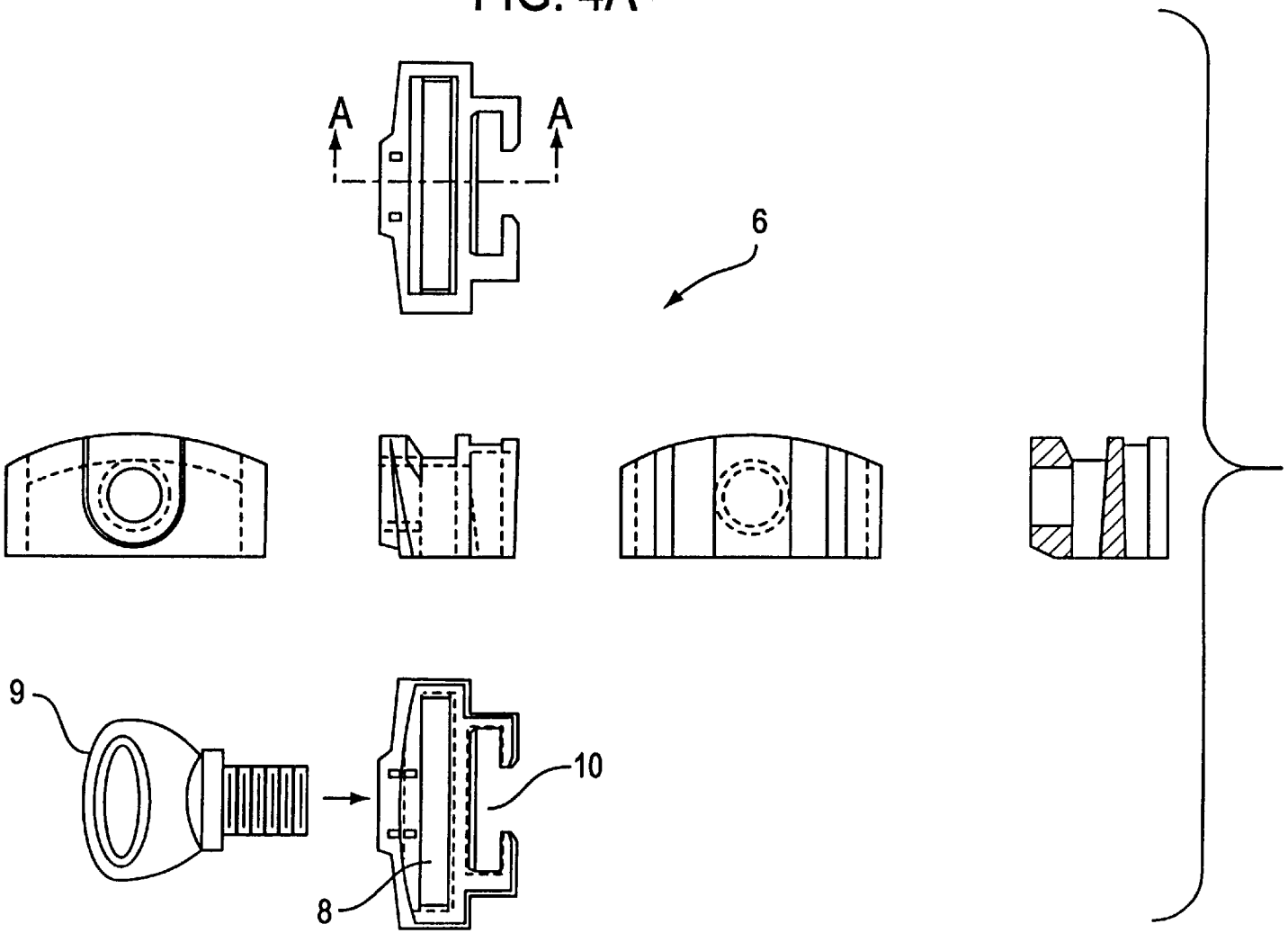
FIGS. 4A and 4B show guides for prestretching elastic.

FIG. 4A shows one embodiment of a guide 6 which is designed for use with elastic. The elastic feeds downward through slot 8 which extends all the way from top to bottom. The top edge of this slot can be beveled to prevent the elastic from snagging and catching as it feeds into the slot. Other edges can be beveled as well. The width of this slot may be identical to, or slightly larger than, the elastic being used. This maintains the elastic in accurate alignment as it feeds out the bottom of the slot and into the sewing area underneath the foot. Non-enclosed slot 10 may be used to mount guide 6 to protrusion 7 on foot 5.

Screw 9 may enter the guide from the front side and penetrate into the slot containing the elastic. By turning the screw inward, the operator can force the elastic against the back wall of the slot. When the elastic is pulled through the slot, this force creates a frictional resistance between the elastic and the back wall of the slot, and also between the elastic and the screw itself. Adjusting the position of the screw allows the operator to provide variable amounts of force on the elastic. This provides a controllable frictional force which resists the pull of the elastic through the slot. As illustrated, screw 9 can be a thumbscrew with a wide flat head to provide more precise control of its position. As previously described, the sewn fabric may be fed across the top of the base by the action of moving teeth underneath the material. Since the front end of the elastic has already been sewn to the fabric, these teeth cause the sewn portion of the elastic to be pulled forward. This pulling action, resisted by the friction within the guide slot, causes the elastic to be stretched. Once the stretched elastic creates a tension greater than this frictional force, the elastic within the guide will move forward. By controlling the position of the screw, and thus the amount of friction, the operator can control the amount of stretch which is being sewn into the elastic.

Figure 4B:
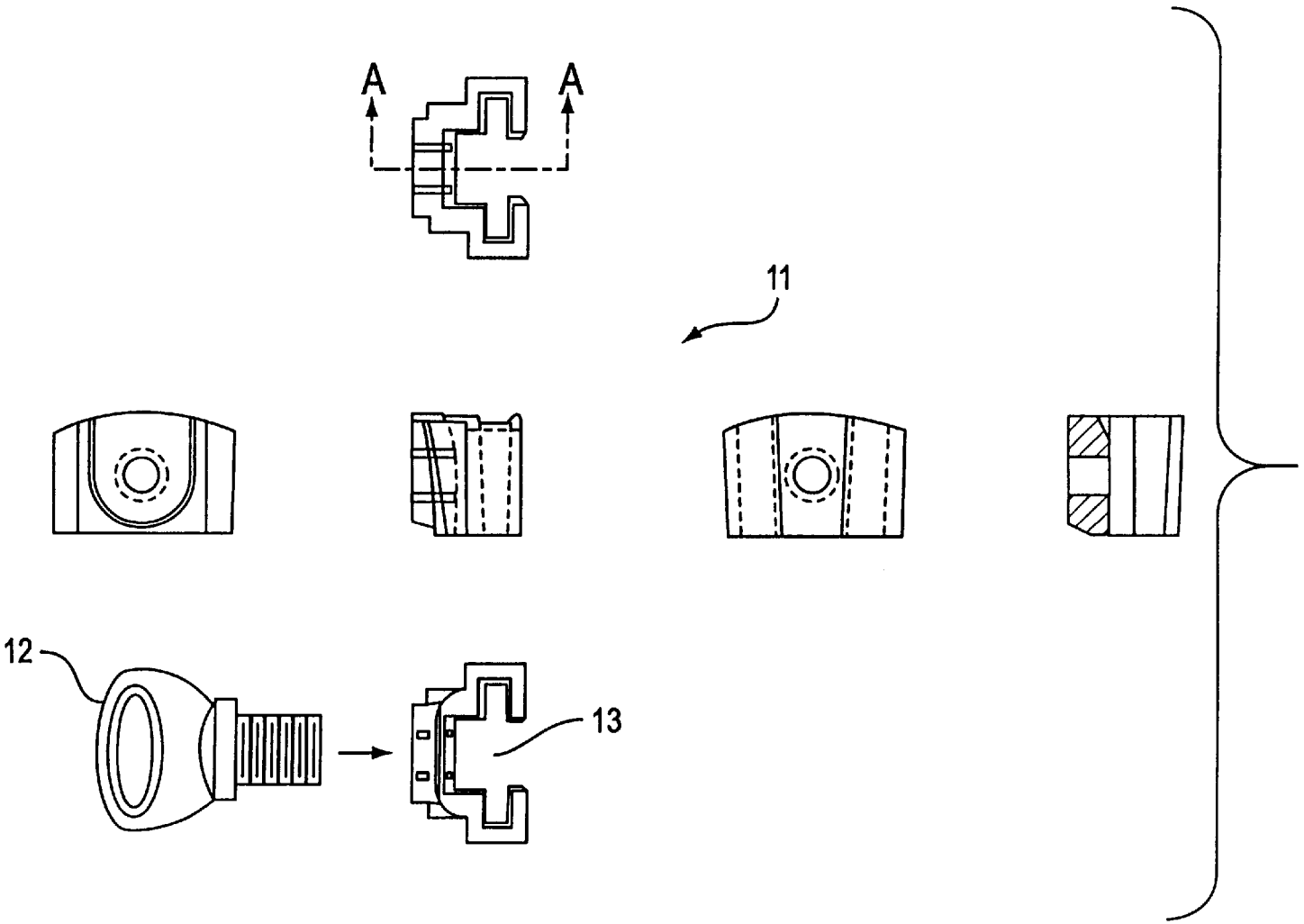

Guide 11 of FIG. 4B represents a slightly different embodiment. In this version, a single staggered-width slot 13 is used to both mount the guide and to provide passage for the elastic. As can be seen, the wide portion of the slot serves to mount the guide by receiving protrusion 7 from the foot. The narrow portion serves as the slot for the elastic. Once guide 11 is mounted, protrusion 7 serves as the back wall for the narrow portion, and screw 12 pushes the elastic against this protrusion. Since this version of the guide is typically used with smaller widths of elastic, a screw 12 with a smaller threaded portion can also be used. Other than these differences, the two embodiments function in the same way.

In an alternative method of use, if the screw is removed or if it is backed out so that it does not contact the material in the slot, then the material will feed through the slot without resistance. This allows the same attachment to be used for a ribbon or other nonstretchable trim material. In such a case, the guide slot serves as a guide which controls the placement of the trim material, but does not provide any pre-stretching function. This is another operation that the operator would have to manually perform in the absence of the guide.

Since elastic and other trim materials come in various widths, the size of the slot in the guide must be changed to accommodate these different widths. This is normally accomplished by providing multiple attachments with various width slots. Although trim materials come in various widths, they normally come in a small number of standard widths, such as one-quarter inch, three-eighths inch, one-half inch, etc. This places a limit on the number of slot widths and hence the number of attachments that are required to accommodate the majority of commonly available trim materials.

Figure 5A:
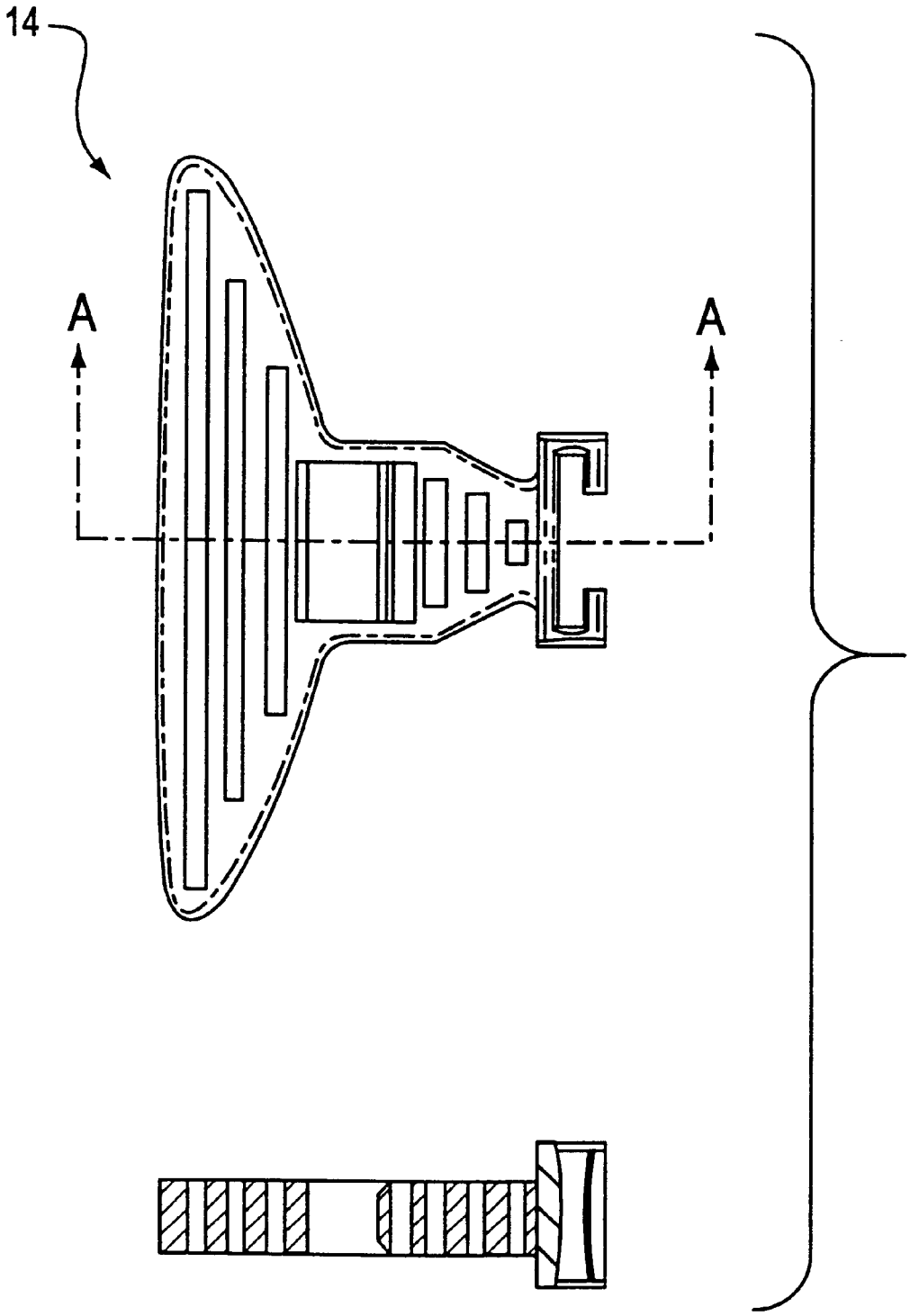
FIGS. 5A and 5B show guides for handling multiple trim pieces.
Figure 5B:
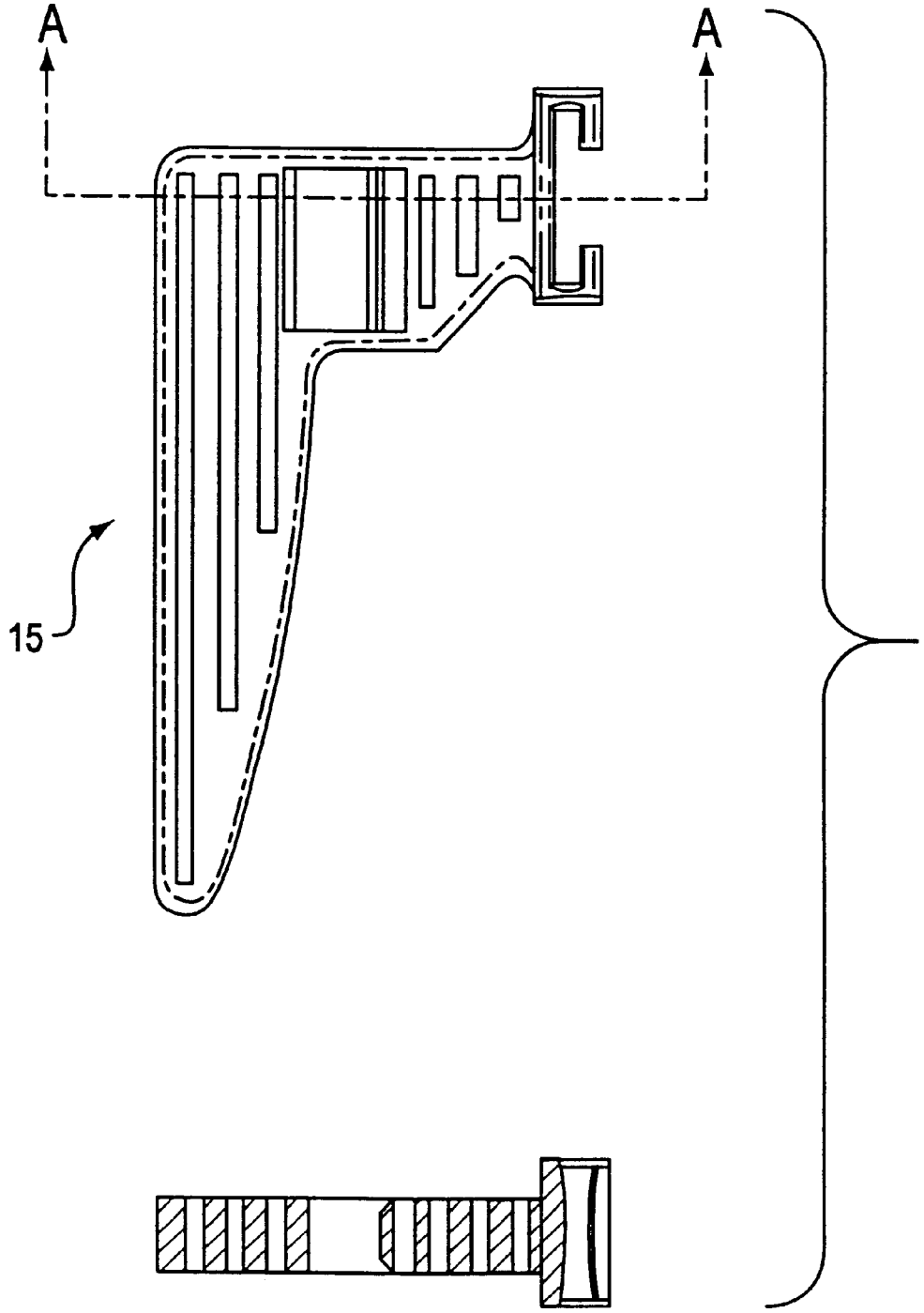

Sometimes the operator may wish to create a layered effect by sewing various ribbons or other trim materials, possibly of different widths and colors, on top of each other. The operator might wish to keep all of these ribbons centered, creating a layered effect that proceeds upward from either side. Alternatively, the operator may wish to align one edge of all the ribbons so that the layered effect proceeds upward from only one side. In either case, it is important to maintain the proper orientation and positional configuration of each item. Such precise control would be very difficult if the operator had to manually hold all of these materials in place while feeding them into the sewing mechanism. FIGS. 5A and 5B show guides which are designed to automate this process. As can be seen, each guide has multiple parallel slots. These slots can be of different widths to accommodate different width trim materials, and are also oriented so that the trim materials maintain their precise positional registration. FIG. 5A shows a guide 14 which centers all of the ribbons while FIG. 5B shows a guide 15 which aligns side of the ribbons. Since not every slot must be used, the operator can use a single guide to sew one, two, or more trim materials together, up to the maximum number of slots. Since a single guide has slots in various widths, different width materials can also be accommodated in various combinations by a single guide, provided the proper widths are found somewhere on that guide. This further reduces the total number of attachments required to accommodate the majority of sewing needs.

Figure 6:
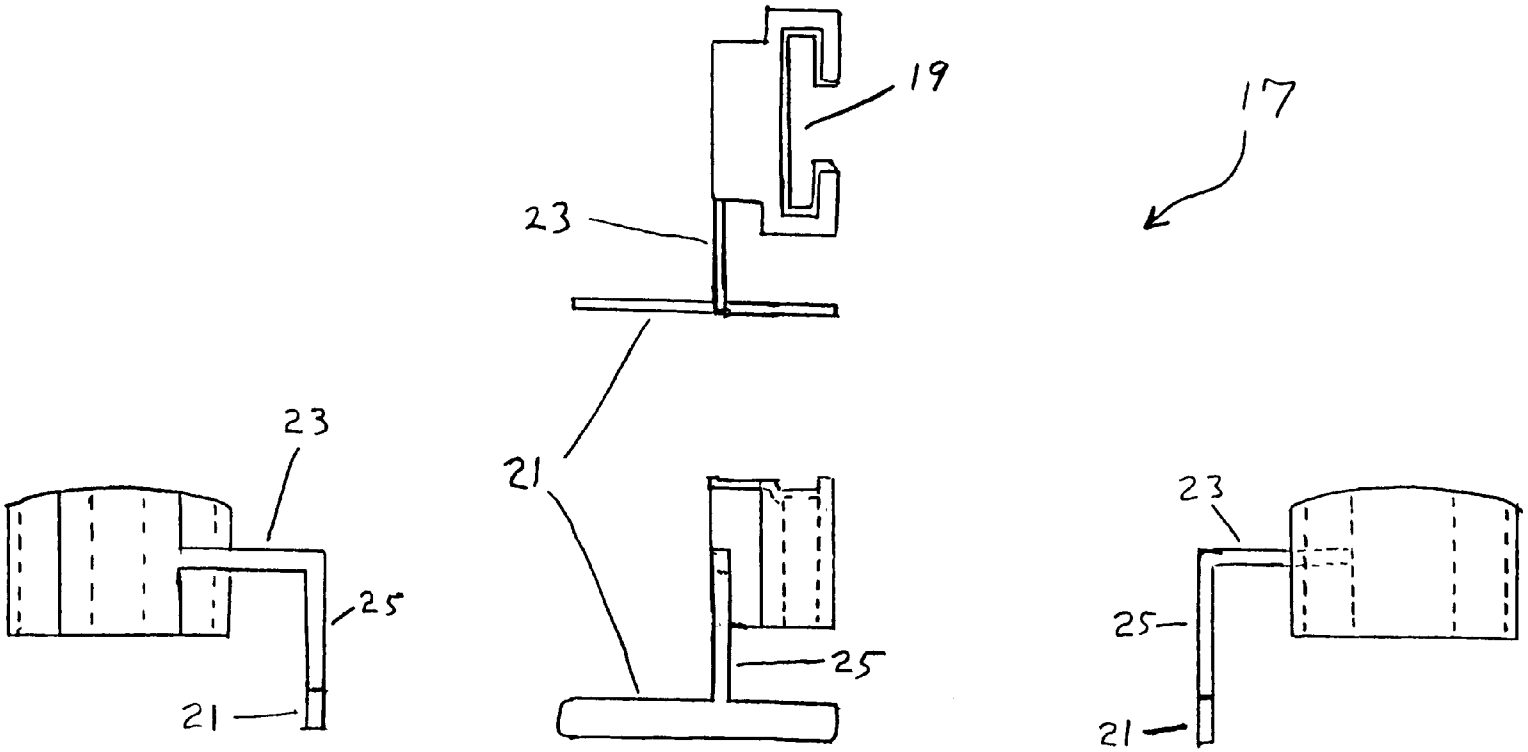
FIG. 6 shows a guide for sewing straight seams.

FIG. 6 shows an accessory head to aid the operator in sewing straight seams. In a manner similar to the other attachments, seam guide accessory 17 can be attached to the sewing machine by inserting protrusion 7 of foot 5 into slot 19. Seam guide accessory 17 includes alignment guide 21, which can have a straight, flat surface running parallel to the direction of motion of the material being sewn. The surface is preferably also perpendicular to the top of base 4. In operation, the operator may place the edge of the material against alignment guide 21 while guiding the material forward under the foot. By maintaining consistent contact between the edge and alignment guide 21, the resulting seam will be straight and parallel to the edge.

Alternately, a line or other reference mark on the material may be guided along the edge of alignment guide 21.

Alignment guide 21 can be attached to the mounting portion of seam guide accessory 17 with an extension. In a preferred embodiment, this extension can include a horizontal arm 23 and a vertical arm 25. The length of vertical arm 25 can be chosen to place alignment guide 21 at or near the top surface of base 4 when seam guide accessory 17 is mounted on foot 5. The length of horizontal arm 23 can be chosen to produce the desired offset distance between the alignment guide 21 and the seam being sewn into the material. A set of several standardized seam attachments may be provided, each with a different horizontal offset to produce a different standard width, such as one inch, one-half inch, three-eighths inch, etc. Alternatively, a single attachment with an adjustable horizontal offset distance can also be provided. Although FIG. 6 depicts the extension as two straight arms 23 and 25 at right angles to each other, various other physical configurations, including, but not limited to, a single curved arm or an angled arm can also be provided. As long as the proper horizontal and vertical placement of alignment guide 21 is maintained, the physical shape of the connecting extension is relatively unimportant.

CUSTOMIZATION

The invention can be customized to meet the unique needs of each user in two ways. The sewing machine market contains a large number of brands and model numbers, and not all of these machines have feet which are compatible with each other. A variety of custom feet can be provided so that an individual user may select the one particular configuration which is compatible with his or her particular sewing machine. In addition, each user may have a variety of needs when it comes to sewing accessories. A variety of accessories makes it possible for each user to select only the accessories needed for his or her particular sewing needs. In this manner the user may customize the foot to the particular machine and may customize the accessories to the particular sewing needs. This allows every individual to select only the equipment needed without having to buy expensive equipment that was designed to provide all options for all users. The very simplicity of the invention allows each user to customize to his or her particular needs easily and inexpensively.

The embodiments described herein are illustrative and not restrictive. Numerous variations may occur to those of skill in the art that fall within the spirit of the invention, such as placing the mounting slot on the foot and the insertable protrusion on the alignment guide. The scope of the invention is therefore limited not by the particular examples described herein, but only by the scope of the attached claims.

What is claimed is:

1. A sewing machine accessory comprising:

a sewing machine foot;

an accessory head detachably connected to the foot;

wherein one of the foot and the accessory head includes a mounting receptacle;

wherein the other of the foot and the accessory head includes a vertical protrusion for insertably fitting within the mounting receptacle.

2. The accessory of claim 1, wherein said accessory head includes an alignment guide for aligning the material being sewn.

3. The accessory of claim 2, wherein the alignment guide includes an alignment element disposed a predetermined offset distance from a center of the foot in a direction perpendicular to a direction of travel of material being sewn.

4. The accessory of claim 3, wherein the alignment element is oriented parallel to the direction of travel of the material being sewn.

5. The accessory of claim 3, wherein the alignment element is disposed adjacent to a top surface of a sewing machine base.

6. The accessory of claim 1, wherein the accessory head and the sewing machine foot are configured to be detachably connected to each other solely by placement of said vertical protrusion in said mounting receptacle.

7. A sewing machine accessory comprising:

a sewing machine shank;

an accessory head detachably connected to the sewing machine shank;

wherein one of the shank and the accessory head includes a mounting receptacle; and wherein the other of the shank and the accessory head includes a vertical protrusion for insertably fitting within the mounting receptacle.

8. The accessory of claim 7, wherein the accessory head includes an alignment guide for aligning material being sewn.

9. The accessory of claim 8, wherein the alignment guide includes an alignment element disposed a predetermined offset distance from a center of the shank in a direction perpendicular to a direction of travel of the material being sewn.

10. The accessory of claim 9, wherein the alignment element is oriented parallel to the direction of travel of the material being sewn.

11. The accessory of claim 9, wherein the alignment element is disposed adjacent to a top surface of a sewing machine base.

12. The accessory of claim 7, wherein the accessory head and the sewing machine shank are configured to be detachably connected to each other solely by placement of said vertical protrusion in said mounting receptacle.

13. A method of attaching an accessory head to a sewing machine, comprising the steps of:

providing a first mounting element on the sewing machine;

providing a second mounting element on the accessory head; and connecting the first mounting element to the second mounting element solely by inserting a vertical protrusion on one of the first and second mounting elements into a mating receptacle on the other of the first and second mounting elements.

14. The method of claim 13, wherein the step of providing a first mounting element includes providing a first mounting element on a sewing machine foot.

15. The method of claim 13, wherein the step of providing a first mounting element includes providing a first mounting element on a sewing machine shank.

16. A method of sewing materials with a sewing machine, comprising the steps of:

providing a vertically mounted alignment guide detachably connected to a foot of said sewing machine; and controllably feeding said material into a sewing mechanism of the sewing machine by maintaining contact between an alignment element of the alignment guide and an edge of the material.

17. A method of sewing materials with a sewing machine, comprising the steps of:

providing an alignment guide having an offset alignment element;

providing a mounting element connected to the sewing machine;

mounting said alignment guide to the mounting element solely by inserting a vertical protrusion into a mounting receptacle; and controllably passing material through a sewing mechanism of the sewing machine using an offset alignment edge as a guide.

* * * * *